US011100866B2

(12) United States Patent
Qing et al.

(10) Patent No.: US 11,100,866 B2
(45) Date of Patent: Aug. 24, 2021

(54) PIXEL CIRCUIT AND DRIVING METHOD THEREOF, AS WELL AS DISPLAY DEVICE

(71) Applicants: CHENGDU BOE OPTOELECTRONICS TECHNOLOGY CO., LTD., Sichuan (CN); BOE TECHNOLOGY GROUP CO., LTD., Beijing (CN)

(72) Inventors: Haigang Qing, Beijing (CN); Weiyun Huang, Beijing (CN)

(73) Assignees: CHENGDU BOE OPTOELECTRONICS TECHNOLOGY CO., LTD., Sichuan (CN); BOE TECHNOLOGY GROUP CO., LTD., Beijing (CN)

( * ) Notice: Subject to any disclaimer, the term of this patent is extended or adjusted under 35 U.S.C. 154(b) by 197 days.

(21) Appl. No.: 16/464,390

(22) PCT Filed: Jan. 4, 2018

(86) PCT No.: PCT/CN2018/070792

§ 371 (c)(1),
(2) Date: May 28, 2019

(87) PCT Pub. No.: WO2018/188390

PCT Pub. Date: Oct. 18, 2018

(65) Prior Publication Data

US 2021/0118371 A1 Apr. 22, 2021

(30) Foreign Application Priority Data

Apr. 14, 2017 (CN) ..... 201710245409.3

(51) Int. Cl.
*G09G 3/3266* (2016.01)
*G09G 3/3275* (2016.01)

(52) U.S. Cl.
CPC ..... *G09G 3/3266* (2013.01); *G09G 3/3275* (2013.01); *G09G 2300/043* (2013.01); *G09G 2330/028* (2013.01)

(58) Field of Classification Search
CPC ..... G09G 3/3266; G09G 3/3275; G09G 2300/043; G09G 2330/028
See application file for complete search history.

(56) References Cited

U.S. PATENT DOCUMENTS

2011/0074757 A1* 3/2011 Chung ..... G09G 3/3233 345/211
2014/0176523 A1 6/2014 Kwak
(Continued)

FOREIGN PATENT DOCUMENTS

CN 104575392 A 4/2015
CN 105185305 A 12/2015
(Continued)

OTHER PUBLICATIONS

Search Report and Written Opinion for International Application No. PCT/CN2018/070792 dated Apr. 3, 2018.
(Continued)

*Primary Examiner* — Premal R Patel
(74) *Attorney, Agent, or Firm* — Calfee, Halter & Griswold LLP

(57) ABSTRACT

A pixel circuit and a driving method thereof, as well as a display device. The pixel circuit includes an initialization signal terminal, a scanning signal terminal, a data signal terminal, a first power supply terminal, a second power supply terminal, a reference voltage terminal a light-emitting signal control terminal, a reset signal terminal, a data writing sub-circuit, a threshold compensation sub-circuit, a light-emitting control sub-circuit, a reset sub-circuit, a storage capacitor, a driver transistor and a light-emitting element. The threshold compensation sub-circuit is configured
(Continued)

to pre-store the threshold voltage of the driver transistor in the storage capacitor.

12 Claims, 6 Drawing Sheets

(56) References Cited

U.S. PATENT DOCUMENTS

| | | | | |
|---|---|---|---|---|
| 2014/0354522 | A1* | 12/2014 | Chung | G09G 3/003 345/82 |
| 2015/0028766 | A1* | 1/2015 | Yang | G09G 3/3233 315/240 |
| 2015/0146977 | A1 | 5/2015 | Ryu | |
| 2016/0063922 | A1* | 3/2016 | Tsai | G09G 3/3291 345/76 |
| 2016/0071461 | A1* | 3/2016 | Lee | G09G 3/3291 345/76 |
| 2016/0104423 | A1* | 4/2016 | Park | G09G 3/3233 345/78 |
| 2016/0351121 | A1 | 12/2016 | Kim et al. | |
| 2016/0351123 | A1 | 12/2016 | Qing et al. | |
| 2017/0270860 | A1 | 9/2017 | Wang et al. | |
| 2018/0286313 | A1 | 10/2018 | Zheng | |

FOREIGN PATENT DOCUMENTS

| | | | |
|---|---|---|---|
| CN | 105931599 | A | 9/2016 |
| CN | 106128362 | A | 11/2016 |
| CN | 106205493 | A | 12/2016 |
| CN | 106297667 | A | 1/2017 |
| CN | 205920745 | U | 2/2017 |
| CN | 106991964 | A | 7/2017 |
| KR | 20120024214 | A | 3/2012 |

OTHER PUBLICATIONS

First Office Action for Chinese Patent Application No. 201710245409.3 dated Oct. 31, 2018.

Second Office Action for Chinese Patent Application No. 201710245409.3 dated Jun. 17, 2019.

* cited by examiner

PRIOR ART

PIXEL CIRCUIT AND DRIVING METHOD THEREOF, AS WELL AS DISPLAY DEVICE

CROSS REFERENCE TO RELATED APPLICATIONS

The present application is the U.S. national phase entry of PCT/CN2018/070792, with an international filing date of Jan. 4, 2018, which claims the benefit of Chinese Patent Application No. 201710245409.3, filed on Apr. 14, 2017, the entire disclosures of which are incorporated herein by reference.

TECHNICAL FIELD

The present disclosure relates to the field of display technology, and more particularly to a pixel circuit and a driving method thereof, as well as a display device comprising the pixel circuit.

BACKGROUND

In comparison with the current mainstream display technology (Thin Film Transistor Liquid Crystal Display, TFT-LCD), Organic Light Emitting Diode (OLED) displays have the advantages of wide viewing angle, high brightness, high contrast, low energy consumption, thinner size and lighter weight, and therefore become the focus of the existing panel display technology.

There are two ways to drive OLED displays, i.e., passive matrix (PM) and active matrix (AM). In comparison with the PM driving, the AM driving has the advantages of large displayed information, lower power consumption, longer device life and high image contrast.

Although there have been proposed many pixel circuits used for AM driving method, the following problems are still unavoidable: the non-uniformity of the threshold voltage of driver transistors due to the manufacturing process leads to the difference of driver transistors at different positions of a display panel. Because the current flowing through a light-emitting element is associated with the threshold voltage of the driver transistor, the brightness of the light-emitting element may be different for the same data driving signal, thereby affecting the image uniformity and luminous quality of the whole OLED display. Moreover, due to the internal resistance of a display, the power supply voltage at different positions of the display will be different. Because the current flowing through a light-emitting element is associated with the power supply voltage of the display, it will also lead to different brightness of the light-emitting element for the same data signal, thereby affecting the uniformity of displayed images.

SUMMARY

The objective of the present disclosure is to provide an improved pixel circuit, a pixel driving method and a display device, which can at least partially alleviate or eliminate one or more of the above-mentioned problems.

According to one embodiment of the present disclosure, there is provided a pixel circuit, comprising: an initialization signal terminal, a scanning signal terminal, a data signal terminal, a first power supply terminal, a second power supply terminal, a reference voltage terminal, a light-emitting signal control terminal, a reset signal terminal, a data writing sub-circuit, a threshold compensation sub-circuit, a light-emitting control sub-circuit, a reset sub-circuit, a storage capacitor, a driver transistor and a light-emitting element.

The data writing sub-circuit is connected with the scanning signal terminal, the data signal terminal and the first terminal of the storage capacitor, and configured to, under the control of the scanning signal inputted from the scanning signal terminal, transmit the data signal inputted from the data signal terminal to the first terminal of the storage capacitor.

The threshold compensation sub-circuit is connected with the first and second poles of the driver transistor, a node, the scanning signal terminal, the reference voltage terminal and the first pole of the light-emitting element, and configured to pre-store the threshold voltage of the driver transistor in the storage capacitor.

The light-emitting control sub-circuit is connected with the first power supply terminal, the first terminal of the storage capacitor, the first pole of the driver transistor and the light-emitting control signal terminal, and configured to, under the control of the light-emitting control signal inputted from the light-emitting control signal terminal, control the driver transistor to drive the light-emitting element to emit light.

The reset sub-circuit is connected with the node, the reset signal terminal and the initialization signal terminal, and configured to, under the control of the reset signal inputted from the reset signal terminal, transmit the initialization signal inputted from the initialization signal terminal to the node.

The second terminal of the storage capacitor and the control pole of the driver transistor are connected with the node, and the second pole of the light-emitting element is connected with the second power supply terminal.

According to some exemplary embodiments, $0<Vref-Vss\leq 0.3V$, wherein Vss is the voltage value inputted from the second power supply terminal, and Vref is the reference voltage value inputted from the reference voltage terminal.

According to some exemplary embodiments, the light-emitting control sub-circuit comprises a first transistor and a second transistor. The first pole of the first transistor is connected with the second pole of the second transistor and the first power supply terminal, the second pole of the first transistor is connected with the threshold compensation sub-circuit and the first pole of the driver transistor, and the control pole of the first transistor is connected with the light-emitting control signal terminal. The first pole of the second transistor is connected with the first terminal of the storage capacitor and the data writing sub-circuit, the second pole of the second transistor is connected with the light-emitting control sub-circuit, and the control pole of the second transistor is connected with the light-emitting control signal terminal.

According to some exemplary embodiments, the threshold compensation sub-circuit comprises a third transistor and a fourth transistor. The first pole of the third transistor is connected with the reference voltage terminal, the second pole of the third transistor is connected with the second pole of the driver transistor and the first pole of the light-emitting element, and the control pole of the third transistor is connected with the scanning signal terminal. The first pole of the fourth transistor is connected with the first pole of the driver transistor, the second pole of the fourth transistor is connected with the node, and the control pole of the fourth transistor is connected with the scanning signal terminal.

According to some exemplary embodiments, the threshold compensation sub-circuit comprises a third transistor and a fourth transistor. The first pole of the third transistor is connected with the reference voltage terminal, the second pole of the third transistor is connected with the first pole of the driver transistor, and the control pole of the third transistor is connected with the scanning signal terminal. The first pole of the fourth transistor is connected with the second pole of the driver transistor, the second pole of the fourth transistor is connected with the node, and the control pole of the fourth transistor is connected with the scanning signal terminal.

According to some exemplary embodiments, the data writing sub-circuit comprises a fifth transistor. The first pole of the fifth transistor is connected with the data signal terminal, the second pole of the fifth transistor is connected with the first terminal of the storage capacitor and the light-emitting control sub-circuit, and the control pole of the fifth transistor is connected with the scanning signal terminal.

According to some exemplary embodiments, the reset sub-circuit comprises a sixth transistor. The first pole of the sixth transistor is connected with the initialization signal terminal, the second pole of the sixth transistor is connected with the node, and the control pole of the sixth transistor is connected with the reset signal terminal.

According to another embodiment of the present disclosure, there is provided a driving method for any pixel circuit as stated above. The method comprises a reset phase, a threshold compensation phase and a light-emitting phase. In the reset phase, under the control of a reset signal inputted from the reset signal terminal, an initialization signal inputted from the initialization signal terminal is transmitted to the node. In the threshold compensation phase, the threshold voltage of the driver transistor is pre-stored in the storage capacitor. In the light-emitting phase, under the control of a light-emitting control signal inputted from the light-emitting signal terminal, the driver transistor is controlled to drive the light-emitting element to emit light.

In some exemplary embodiments, in the threshold compensation phase, $0<Vref-Vss\leq 0.3V$, wherein Vss is the voltage value inputted from the second power supply terminal, and Vref is the reference voltage value inputted from the reference voltage terminal.

According to a further embodiment of the present disclosure, there is provided a display device comprising any pixel circuit as stated above.

According to yet another embodiment of the present disclosure, there is provided a pixel circuit, comprising an initialization signal terminal, a scanning signal terminal, a data signal terminal, a first power supply terminal, a second power supply terminal, a reference voltage terminal, a light-emitting signal control terminal, a reset signal terminal, a first transistor, a second transistor, a third transistor, a fourth transistor, a fifth transistor, a sixth transistor, a driver transistor, a storage capacitor and a light-emitting element.

The first pole of the first transistor is connected with the second pole of the second transistor and the first power supply terminal, the second pole of the first transistor is connected with the first pole of the fourth transistor and the first pole of the driver transistor, and the control pole of the first transistor is connected with the light-emitting control signal terminal.

The first pole of the second transistor is connected with the first terminal of the storage capacitor and the second pole of the fifth transistor, the second pole of the second transistor is connected with the first pole of the first transistor and the first power supply terminal, and the control pole of the second transistor is connected with the light-emitting control signal terminal.

The first pole of the third transistor is connected with the reference voltage terminal, the second pole of the third transistor is connected with the second pole of the driver transistor and the first pole of the light-emitting element, and the control pole of the third transistor is connected with the scanning signal terminal.

The first pole of the fourth transistor is connected with the first pole of the driver transistor, the second pole of the fourth transistor is connected with the second pole of the sixth transistor and the node, and the control pole of the fourth transistor is connected with the scanning signal terminal.

The first pole of the fifth transistor is connected with the data signal terminal, the second pole of the fifth transistor is connected with the first terminal of the storage capacitor and the first pole of the second transistor, and the control pole of the fifth transistor is connected with the scanning signal terminal.

The first pole of the sixth transistor is connected with the initialization signal terminal, the second pole of the sixth transistor is connected with the node, and the control pole of the sixth transistor is connected with the reset signal terminal.

The first terminal of the storage capacitor is connected with the first pole of the second transistor and the second pole of the fifth transistor, and the second terminal of the storage capacitor is connected with the node.

The first pole of the driver transistor is connected with the second pole of the first transistor and the first pole of the fourth transistor, the second pole of the driver transistor is connected with the first pole of the light-emitting element and the second pole of the third transistor, and the control pole of the driver transistor is connected with the node.

The first pole of the light-emitting element is connected with the second pole of the third transistor and the second pole of the driver transistor, and the second pole of the light-emitting element is connected with the second power supply terminal.

According to yet another embodiment of the present disclosure, there is provided a pixel circuit, comprising an initialization signal terminal, a scanning signal terminal, a data signal terminal, a first power supply terminal, a second power supply terminal, a reference voltage terminal, a light-emitting signal control terminal, a reset signal terminal, a first transistor, a second transistor, a third transistor, a fourth transistor, a fifth transistor, a sixth transistor, a driver transistor, a storage capacitor and a light-emitting element.

The first pole of the first transistor is connected with the second pole of the second transistor and the first power supply terminal, the second pole of the first transistor is connected with the first pole of the fourth transistor and the first pole of the driver transistor, and the control pole of the first transistor is connected with the light-emitting control signal terminal.

The first pole of the second transistor is connected with the first terminal of the storage capacitor and the second pole of the fifth transistor, the second pole of the second transistor is connected with the first pole of the first transistor and the first power supply terminal, and the control pole of the second transistor is connected with the light-emitting control signal terminal.

The first pole of the third transistor is connected with the reference voltage terminal, the second pole of the third transistor is connected with the second pole of the first transistor and the first pole of the driver transistor, and the control pole of the third transistor is connected with the scanning signal terminal.

The first pole of the fourth transistor is connected with the second pole of the driver transistor, the second pole of the fourth transistor is connected with the node, and the control pole of the fourth transistor is connected with the scanning signal terminal.

The first pole of the fifth transistor is connected with the data signal terminal, the second pole of the fifth transistor is connected with the first terminal of the storage capacitor and the first pole of the second transistor, and the control pole of the fifth transistor is connected with the scanning signal terminal.

The first pole of the sixth transistor is connected with the initialization signal terminal, the second pole of the sixth transistor is connected with the node, and the control pole of the sixth transistor is connected with the reset signal terminal.

The first terminal of the storage capacitor is connected with the first pole of the second transistor and the second pole of the fifth transistor, and the second terminal of the storage capacitor is connected with the node.

The first pole of the driver transistor is connected with the second pole of the first transistor and the second pole of the third transistor, the second pole of the driver transistor is connected with the first pole of the light-emitting element and the first pole of the fourth transistor, and the control pole of the driver transistor is connected with the node.

The first pole of the light-emitting element is connected with the first pole of the fourth transistor and the second pole of the driver transistor, and the second pole of the light-emitting element is connected with the second power supply terminal.

In the pixel circuit and the driving method thereof according to the present exemplary embodiment, the threshold voltage of the driver transistor is pre-stored in the storage capacitor in the threshold compensation phase, so that, when the light-emitting element is driven to emit light in the light-emitting phase, the threshold voltage of the driver transistor pre-stored in the storage capacitor counteracts the threshold voltage in the current that drives the light-emitting element to emit light, thereby eliminating the influences on the light brightness of the light-emitting element by the variations of the threshold voltage of the driver transistor in the pixel circuit and thus guaranteeing the quality of displayed images. Furthermore, in the light-emitting control phase, the gate-source voltage of the driver transistor DTFT is not associated with the voltage value inputted from the first power supply terminal, the current flowing through the light-emitting element is not influenced by the internal resistance of the display device, thereby solving the IR-drop problem.

DETAILED DESCRIPTION

Figure 1:
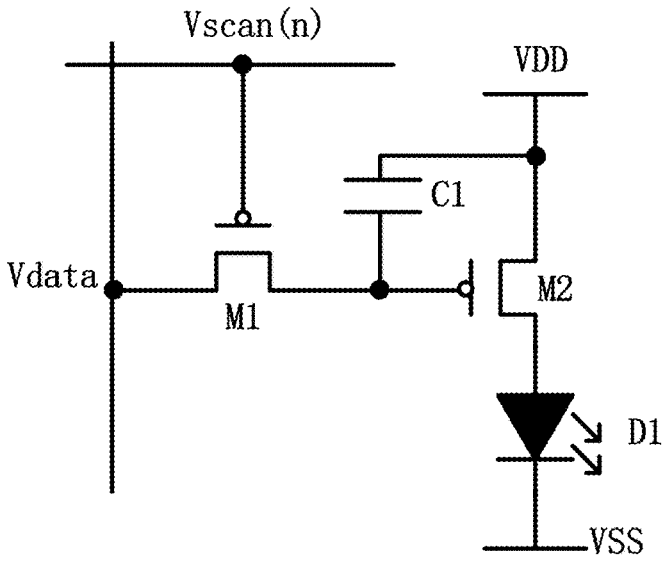
FIG. 1 is a circuit diagram of a conventional pixel circuit.

To enable those skilled in the art to better understand the technical solutions of the present disclosure, the present disclosure will be further described in detail with reference to the drawings and embodiments.

It needs to be noted that the transistor used in the exemplary embodiments of the present disclosure may be a thin film transistor or a field effect transistor or other means with the same characteristics. Because the source and drain of a transistor are interchangeable under certain conditions, there is no essential difference between the source and drain in the depiction of the connection relationship. In the exemplary embodiment of the present disclosure, in order to distinguish the source and drain of a transistor, one is called a first pole, the other is called a second pole, and a gate is called a control pole. Transistors can be divided into N-type and P-type according to their characteristics. In the following exemplary embodiments, explanation is made on the basis of a P-type transistor. When a P-type transistor is used, the first pole is the source of the P-type transistor and the second pole is the drain of the P-type transistor, and the P-type transistor is turned on when the gate input is at a low level. The reverse is true for an N-type transistor. Under the teaching of the present disclosure, those skilled in the art may use an N-type transistor to replace one or more P-type transistors in the drawings without departing from the spirit and scope of the present disclosure.

FIG. 1 illustrates a circuit diagram of a conventional pixel circuit. As shown in FIG. 1, the pixel circuit comprises a scanning signal terminal Vscan(n), a data signal terminal Vdata, a first power supply terminal VDD, a second power supply terminal VSS, a first switch transistor M1, a driver transistor M2, a storage capacitor C1 and a light-emitting element D1. The control pole of the first switch transistor M1 is connected with the scanning signal terminal Vscan(n), the first pole of the first switch transistor M1 is connected with the data signal terminal Vdata, and the second pole of the first switch transistor M1 is connected with the control pole of the driver transistor M2. The first pole of the driver transistor M2 is connected with the first power supply terminal VDD, and the second pole of the driver transistor M2 is connected with a terminal of the light-emitting element D1. The storage capacitor C1 is connected between the control pole and the first pole of the driver transistor M2. The first switch transistor M1 is turned on in response to an active level received from the scanning signal terminal Vscan(n), thereby transmitting the data signal inputted from the data signal terminal Vdata to the control pole of the driver transistor M2. The driver transistor M2 is turned on in response to the received active data signal, thereby transmitting the power supply signal inputted from the power supply terminal to a terminal of the light-emitting element D1 to enable the light-emitting element D1 to emit light. The current flowing through the light-emitting element D1 is decided by the voltage difference Vsg between the control pole and the first pole of the driver transistor M2, and the threshold voltage Vth of the driver transistor M2, wherein Vsg=VDD−Vdata. The storage capacitor C1 is configured to maintain the stability of the voltage difference between the first pole and the control pole of the driver transistor M2 within a frame time.

When a plurality of pixel circuits as shown in FIG. 1 are cascaded, an active level is received from the scanning signal terminal Vscan(n) of an n-th row of pixel circuits, thereby charging the storage capacitor C1 by the data signal inputted from the data signal terminal Vdata. Then, an inactive level is inputted into the scanning signal terminal Vscan(n) of the n-th row of pixel circuits. At this time, the storage capacitor C1 maintains a charging voltage so as to ensure that the driver transistor M2 of the n-th row of pixel circuits outputs a stable current, and therefore the light-emitting element D1 of the n-th row of pixel circuits emits light continuously until a frame time finishes. A frame time generally refers to the time between two active levels received by the same row of pixel circuits from the scanning signal terminal Vscan(n).

After the charging of the n-th row of pixel circuits is finished, an active level is received from the scanning signal terminal Vscan(n+1) of an (n+1)-th row of pixel circuits, thereby charging the storage capacitor C1 by the data signal inputted from the data signal terminal Vdata. Then, an inactive level is inputted into the scanning signal terminal Vscan(n+1) of the (n+1)-th row of pixel circuits. At this time, the storage capacitor C1 maintains a charging voltage so as to ensure that the driver transistor M2 of the (n+1)-th row of pixel circuits outputs a stable current, and therefore the light-emitting element D1 of the (n+1)-th row of pixel circuits emits light continuously until a frame time finishes. Go on doing like this until the charging of the last row of pixel circuits is finished, and then the first row of pixel circuits are recharged. The inventors realized that in the pixel circuit shown in FIG. 1, since the current flowing through the light-emitting element D1 is associated with the threshold voltage of the driver transistor M2 and the power supply voltage VDD, the brightness of the light-emitting element D1 may be different with respect to the same data driving signal Vdata, thereby affecting the image uniformity and luminous quality of the whole OLED display.

Figure 2:
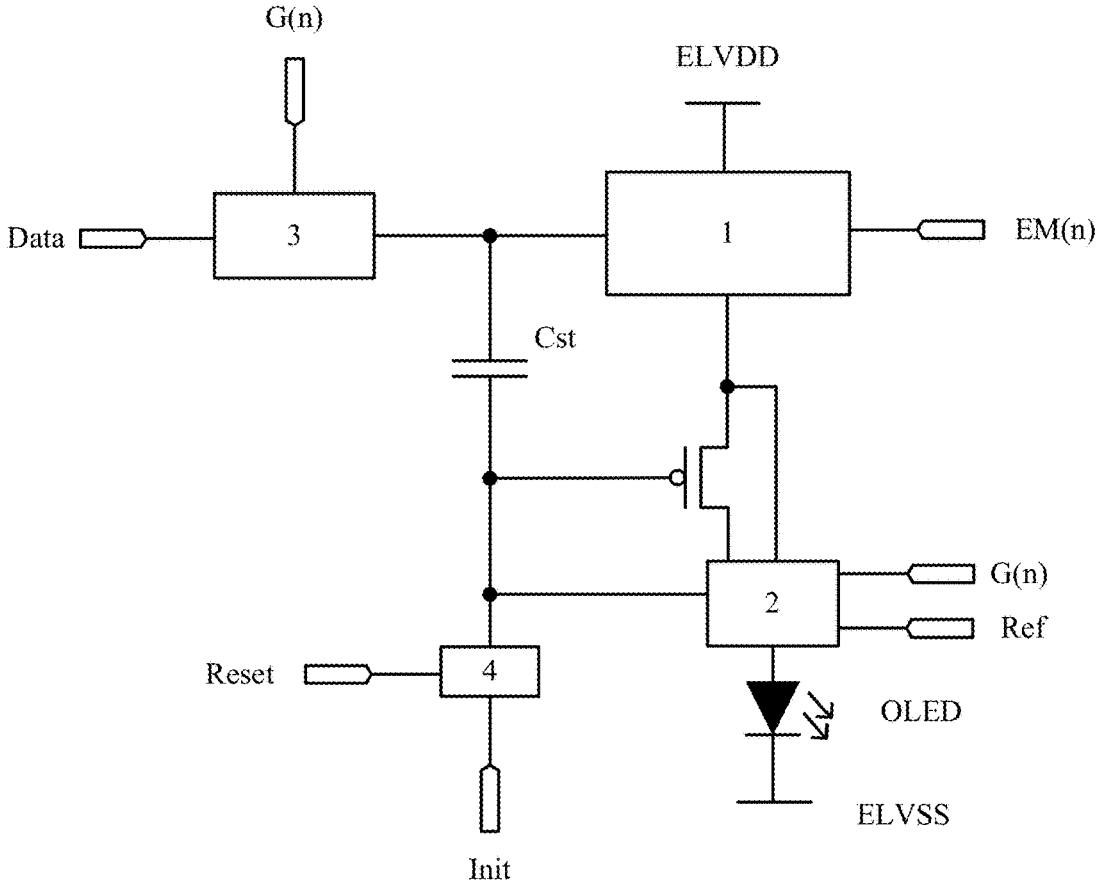
FIG. 2 is a structural block diagram of a pixel circuit according to an exemplary embodiment of the present disclosure.

In view of this, the exemplary embodiment of the present disclosure provides a pixel circuit. As shown in FIG. 2, the pixel circuit comprises an initialization signal terminal Init, a scanning signal terminal G(n), a data signal terminal Data, a first power supply terminal ELVDD, a second power supply terminal ELVSS, a reference voltage terminal Ref, a light-emitting signal control terminal EM(n), a reset signal terminal Reset, a data writing sub-circuit 3, a threshold compensation sub-circuit 2, a light-emitting control sub-circuit 1, a reset sub-circuit 4, a storage capacitor Cst, a driver transistor DTFT and a light-emitting element OLED. The data writing sub-circuit 3 is connected with the scanning signal terminal G(n), the data signal terminal Data and the first terminal of the storage capacitor Cst, and configured to, under the control of the scanning signal inputted from the scanning signal terminal G(n), transmit the data signal inputted from the data signal terminal Data to the first terminal of the storage capacitor Cst. The threshold compensation sub-circuit 2 is connected with the first and second poles of the driver transistor DTFT, a node P, the scanning signal terminal G(n), the reference voltage terminal Ref and the first pole of the light-emitting element OLED, and configured to pre-store the threshold voltage of the driver transistor DTFT in the storage capacitor Cst. The light-emitting control sub-circuit 1 is connected with the first power supply terminal ELVDD, the first terminal of the storage capacitor Cst, the first pole of the driver transistor DTFT and the light-emitting control signal terminal EM(n), and configured to, under the control of the light-emitting control signal inputted from the light-emitting control signal terminal EM(n), control the driver transistor DTFT to drive the light-emitting element OLED to emit light. The reset sub-circuit 4 is connected with the node P, the reset signal terminal Reset and the initialization signal terminal Init, and configured to, under the control of the reset signal inputted from the reset signal terminal Reset, transmit the initialization signal inputted from the initialization signal terminal Init to the node P. The second terminal of the storage capacitor Cst and the control pole of the driver transistor DTFT are connected with the node P, and the second pole of the light-emitting element OLED is connected with the second power supply terminal ELVSS. In the pixel circuit of the present exemplary embodiment, the threshold voltage of the driver transistor DTFT is pre-stored in the storage capacitor Cst in the threshold compensation phase, so that, when the light-emitting element OLED is driven to emit light in the light-emitting phase, the threshold voltage of the driver transistor DTFT pre-stored in the storage capacitor Cst counteracts the threshold voltage in the current that drives the light-emitting element OLED to emit light, thereby eliminating the influences on the light brightness of the light-emitting element OLED by the variations of the threshold voltage of the driver transistor DTFT in the pixel circuit and thus guaranteeing the quality of displayed images. Furthermore, as stated below in detail, in the light-emitting control phase, the gate-source voltage of the driver transistor DTFT is not associated with the voltage value inputted from the first power supply terminal ELVDD, the current flowing through the light-emitting element OLED is not influenced by the internal resistance of the display device, thereby solving the IR-drop problem.

Figure 3:
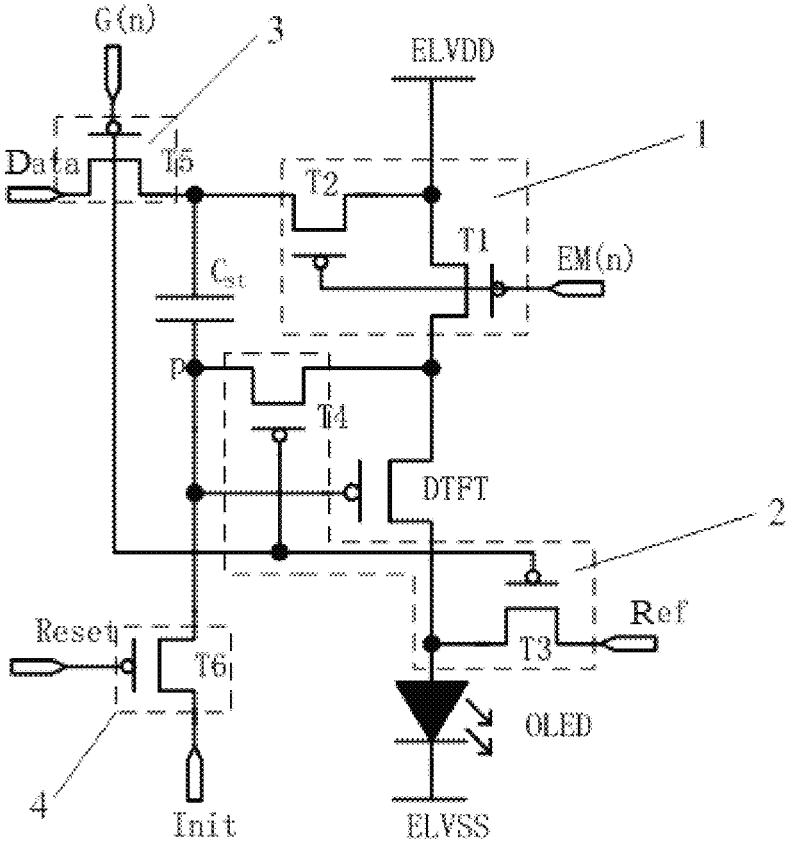
FIG. 3 is a circuit diagram of a pixel circuit according to an exemplary embodiment of the present disclosure.

FIG. 3 illustrates a specific circuit diagram of a pixel circuit in FIG. 2 according to an exemplary embodiment of the present disclosure. As shown in FIG. 3, the light-emitting control sub-circuit 1 may comprise a first transistor T1 and a second transistor T2. The first pole of the first transistor T1 is connected with the second pole of the second transistor T2 and the first power supply terminal ELVDD, the second pole of the first transistor T1 is connected with the threshold compensation sub-circuit 2 and the first pole of the driver transistor DTFT, and the control pole of the first transistor T1 is connected with the light-emitting control signal terminal EM(n). The first pole of the second transistor T2 is connected with the first terminal of the storage capacitor Cst and the data writing sub-circuit 3, the second pole of the second transistor T2 is connected with the light-emitting control sub-circuit 1, and the control pole of the second transistor T2 is connected with the light-emitting control signal terminal EM(n).

To be specific, when an active level is inputted from the light-emitting control signal terminal, the first transistor T1 and the second transistor T2 are turned on. Then, the first pole and the control pole of the driver transistor DTFT are connected by the storage capacitor Cst.

In certain exemplary embodiments, as shown in FIG. 3, the threshold compensation sub-circuit 2 comprises a third transistor T3 and a fourth transistor T4. The first pole of the third transistor T3 is connected with the reference voltage terminal Ref, the second pole of the third transistor T3 is connected with the second pole of the driver transistor DTFT and the first pole of the light-emitting element OLED, and the control pole of the third transistor T3 is connected with the scanning signal terminal G(n). The first pole of the fourth transistor T4 is connected with the first pole of the driver transistor DTFT, the second pole of the fourth transistor T4 is connected with the node P, and the control pole of the fourth transistor T4 is connected with the scanning signal terminal G(n).

To be specific, when an active level is inputted from the scanning signal terminal G(n), the third transistor T3 and the fourth transistor T4 are turned on. Then, the driver transistor DTFT is turned on in the form of a diode due to the fourth transistor T4. Since the third transistor T3 is turned on, the reference voltage Vref inputted from the reference voltage terminal Ref charges the storage capacitor Cst through the driver transistor DTFT. With the continuous in-flow of charges, the potential of the node P keeps rising. When the potential of the node P rises to Vref−|Vthd| (Vthd is the threshold voltage of the driver transistor DTFT), the driver transistor DTFT is cut off, and charging is finished.

In certain exemplary embodiments, as shown in FIG. 3, the data writing sub-circuit 3 comprises a fifth transistor T5. The first pole of the fifth transistor T5 is connected with the data signal terminal Data, the second pole of the fifth transistor T5 is connected with the first terminal of the storage capacitor Cst and the light-emitting control sub-circuit 1, and the control pole of the fifth transistor T5 is connected with the scanning signal terminal G(n).

To be specific, when an active level is inputted from the scanning signal terminal G(n), the fifth transistor T5 is turned on. At this time, the data signal Vdata inputted from the data signal terminal Data is transmitted to the first terminal of the storage capacitor Cst through the fifth transistor T5.

In certain exemplary embodiments, as shown in FIG. 3, the reset sub-circuit 4 comprises a sixth transistor T6. The first pole of the sixth transistor T6 is connected with the initialization signal terminal Init, the second pole of the sixth transistor T6 is connected with the node P, and the control pole of the sixth transistor T6 is connected with the reset signal terminal Reset.

To be specific, when an active level is inputted from the reset signal terminal Reset, the sixth transistor T6 is turned on. At this time, the initialization signal inputted from the initialization signal terminal Init is transmitted to the node P through the sixth transistor T6 so as to reset the node P.

As used herein, the term "active level" refers to the level that turns on a corresponding transistor. For instance, when a corresponding transistor is a P-type transistor, the active level is a low level; and when a corresponding transistor is an N-type transistor, the active level is a high level.

Correspondingly, the present exemplary embodiment provides a driving method of the pixel circuit. The driving method comprises: a reset phase, in which, under the control of a reset signal inputted from a reset signal terminal, an initialization signal inputted from the initialization signal terminal is transmitted to a node; a threshold compensation phase, in which the threshold voltage of a driver transistor is pre-stored in a storage capacitor; and a light-emitting phase, in which, under the control of a light-emitting control signal inputted from a light-emitting signal terminal, the driver transistor is controlled to drive a light-emitting element to emit light.

In the driving method of the pixel circuit according to the present exemplary embodiment, the threshold voltage of the driver transistor is pre-stored in the storage capacitor in the threshold compensation phase, so that, when the light-emitting element is driven to emit light in the light-emitting phase, the threshold voltage of the driver transistor pre-stored in the storage capacitor counteracts the threshold voltage in the current that drives the light-emitting element to emit light, thereby eliminating the influences on the light brightness of the light-emitting element by the variations of the threshold voltage of the driver transistor in the pixel circuit and thus guaranteeing the quality of displayed images. Furthermore, as stated below in detail, in the light-emitting control phase, the gate-source voltage of the driver transistor DTFT is not associated with the voltage value inputted from the first power supply terminal, the current flowing through the light-emitting element is not influenced by the internal resistance of the display device, thereby solving the IR-drop problem.

To make clearer the pixel circuit and the driving method thereof according to the present exemplary embodiment, the working principle and process of the pixel circuit shown in FIG. 3 will be described in detail with reference to the sequence diagram shown in FIG. 4.

It should be noted that the transistors shown in FIG. 3 are taken as P-type transistors for example, and the active level of each transistor is a low level.

Figure 4:
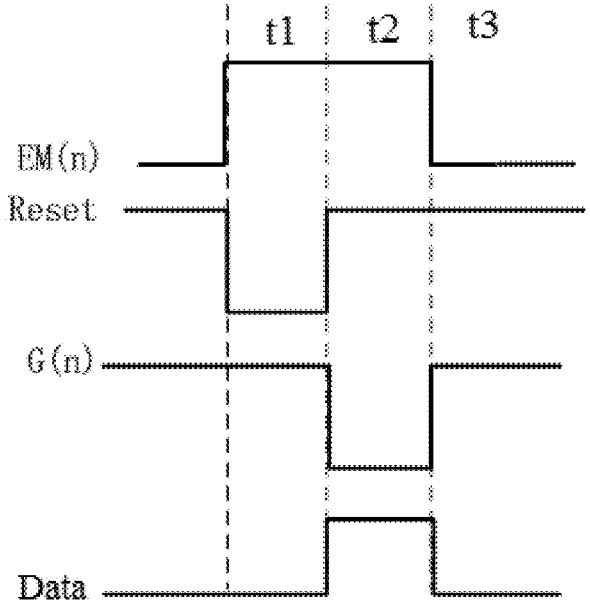
FIG. 4 is a timing sequence diagram of a driving method of the pixel circuit shown in FIG. 3.
Figure 5:
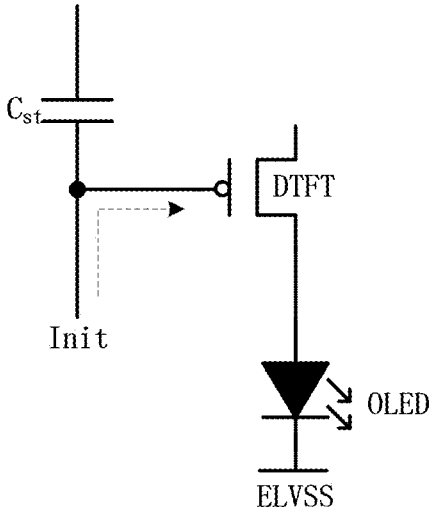
FIG. 5 is an equivalent circuit diagram of the pixel circuit shown in FIG. 3 in a reset phase.

As shown in FIG. 4, in the reset phase t1, a low level is inputted from the reset signal terminal Reset, a high level is inputted from the light-emitting control signal terminal EM(n), and a high level is inputted from the scanning signal terminal G(n). At this time, the first transistor T1, the second transistor T2, the third transistor T3, the fourth transistor T4 and the fifth transistor T5 are cut off, and the sixth transistor T6 is turned on. An equivalent circuit diagram is shown in FIG. 5. Since the sixth transistor T6 is turned on, the initialization signal inputted from the initialization signal terminal Init is transmitted to the control pole of the driver circuit DTFT through the sixth transistor T6 to reset the control pole of the driver circuit DTFT, thereby getting ready for the threshold compensation in the next phase. Meanwhile, since the first transistor T1 is cut off, there is no current flowing through the driver transistor DTFT in this phase, and the light-emitting element OLED does not emit light.

Figure 6:
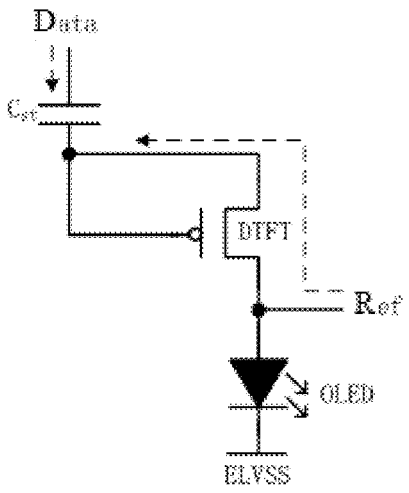
FIG. 6 is an equivalent circuit diagram of the pixel circuit shown in FIG. 3 in a threshold compensation phase.

In the threshold compensation phase t2, a high level is inputted from the reset signal terminal Reset, a high level is inputted from the light-emitting control signal terminal EM(n), a low level is inputted from the scanning signal terminal G(n), and a high level is inputted from the data signal terminal Data. At this time, the first transistor T1, the second transistor T2 and the sixth transistor T6 are cut off, and the third transistor T3, the fourth transistor T4 and the fifth transistor T5 are turned on. An equivalent circuit diagram is shown in FIG. 6. In this phase, since the fourth transistor T4 is turned on, the driver transistor DTFT is connected in the form of a diode. Since the third transistor T3 is turned on, the reference voltage Vref inputted from the reference voltage terminal Ref is transmitted to the first pole of the light-emitting element OLED through the third transistor T3.

In certain exemplary embodiments, the voltage value inputted from the second power supply terminal ELVSS is Vss, the reference voltage value from the reference voltage terminal Ref is Vref, and $0<Vref-Vss\leq 0.3V$.

In such an exemplary embodiment, the reference voltage value Vref is relatively close to the voltage value Vss inputted from the second power supply terminal ELVSS, and the voltage difference between Vref and Vss is mainly used to ensure that no current flows through the light-emitting element OLED in the threshold compensation phase, and meanwhile the reference voltage Vref enters into the first pole of the light-emitting element OLED to reset the light-emitting element OLED, eliminate non-combined charge carriers on the light-emitting interface within the light-emitting element OLED, and alleviate the aging of the light-emitting element OLED. Of course, as realized by those skilled in the art, 0.3V is only an example. Under the teaching of the present disclosure, those skilled in the art can arrange other voltage difference.

In the threshold compensation phase t2, the reference voltage Vref is set to be greater than the initialization signal inputted from the initialization signal terminal Init by the absolute value of the threshold voltage of the driver transistor DTFT. At this time, the control pole of the driver transistor DTFT is still an initialization signal, so the driver transistor DTFT is turned on in the form of a diode due to the fourth transistor T4, so that the reference voltage Vref charges the storage capacitor Cst through the driver transistor DTFT. With the continuous in-flow of charges, the potential of the node P keeps rising. When the potential of the node P rises to be less than the reference voltage Vref by the threshold voltage of the driver transistor DTFT, the driver transistor DTFT is cut off, and charging is finished. Since the fifth transistor T5 is turned on, the data voltage inputted from the data signal terminal Data is transmitted to the first terminal of the storage capacitor Cst. Thus, when the threshold compensation phase ends, the voltage difference between the two terminals of the storage capacitor Cst is: $V(Cst)=Vdata-(Vref-|Vthd|)$, wherein Vthd is the threshold voltage of the driver transistor DTFT.

Figure 7:
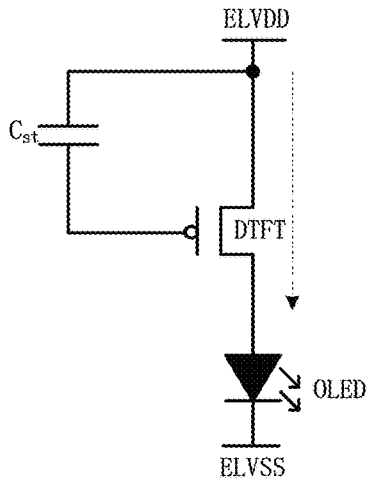
FIG. 7 is an equivalent circuit diagram of the pixel circuit shown in FIG. 3 in a light-emitting phase.

In the light-emitting phase t3, a high level is inputted from the reset signal terminal Reset and the scanning signal terminal G(n), and a low level is inputted from the light-emitting control signal terminal EM(n). At this time, the third transistor T3, the fourth transistor T4, the fifth transistor T5 and the sixth transistor T6 are cut off, and the first transistor T1 and the second transistor T2 are turned on. An equivalent circuit diagram is shown in FIG. 7. In this phase, the first power supply voltage VDD inputted from the first power supply terminal ELVDD is transmitted to the first terminal of the storage capacitor Cst by the second transistor T2. Due to the booting action of the storage capacitor Cst, the voltage difference between both terminals of the storage capacitor Cst remains unchanged, i.e., $V(Cst)=Vdata-(Vref-|Vthd|)$. Thus, the potential of the node P jumps to $VDD-V(Cst)=VDD-Vdata+(Vref-|Vthd|)=VDD-Vdata+Vref-|Vthd|$. Since the control pole of the driver transistor DTFT is connected with the first node P, the potential of the control pole of the driver transistor DTFT is also $VDD-Vdata+Vref-|Vthd|$. On the other hand, the first power supply voltage VDD inputted from the first power supply terminal ELVDD is transmitted to the first pole of the driver transistor DTFT by the first transistor T1. Thus, in this phase, the source-gate voltage of the driver transistor DTFT is $Vsg=VDD-(VDD-Vdata+Vref-|Vthd|)=Vdata-Vref+|Vthd|$, wherein Vth is the threshold voltage of the driver transistor DTFT.

Since the first power supply voltage VDD inputted from the first power supply terminal ELVDD can ensure that the driver transistor DTFT works in saturation state, the current flowing through the light-emitting element OLED is $I_{oled}-K(Vsg-|Vth|)^2=K(Vdata-Vref+|Vthd|-|Vthd|)^2=K(Vdata-Vref)$, wherein K is a constant related to process and design.

As known from the above equation, the light-emitting current of the light-emitting element OLED is only associated with the data voltage Vdata and the reference voltage Vref, and not associated with the threshold voltage Vthd of the driver transistor DTFT and the first power supply voltage VDD.

Figure 8:
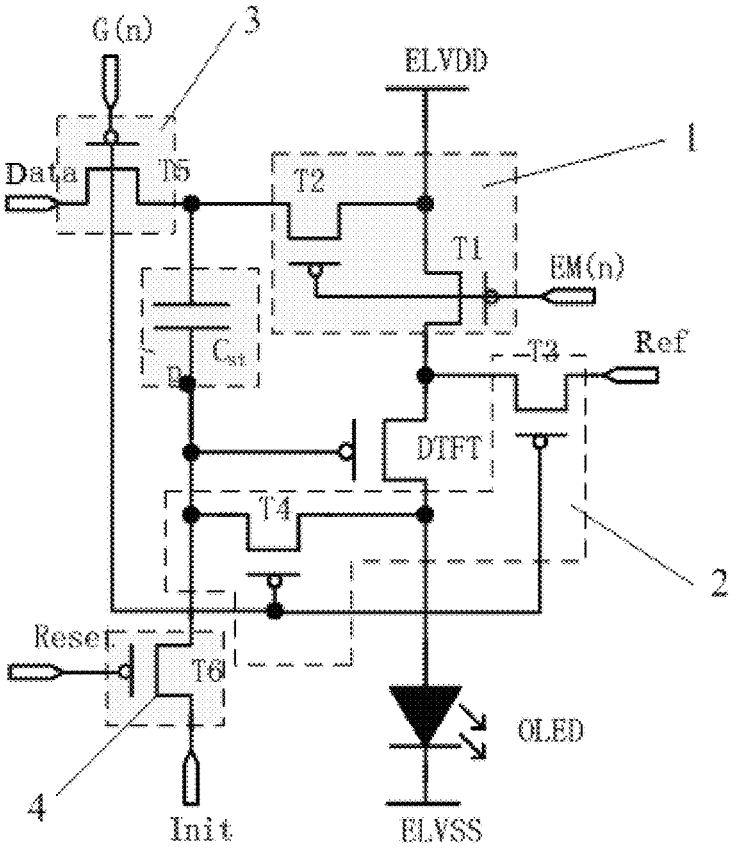
FIG. 8 is a circuit diagram of another pixel circuit according to an exemplary embodiment of the present disclosure.

FIG. 8 illustrates another specific circuit diagram of a pixel circuit shown in FIG. 2 according to an exemplary embodiment of the present disclosure. The specific circuit diagram shown in FIG. 8 differs from the one in FIG. 3 only in the threshold compensation sub-circuit 2. Thus, only the threshold compensation sub-circuit 2 in FIG. 8 will be described in detail, and those identical with the parts in FIG. 3 will not be reiterated. As shown in FIG. 8, the threshold compensation sub-circuit 2 comprises the third transistor T3 and the fourth transistor T4. The control pole of the third transistor T3 is connected with the scanning signal terminal G(n), the first pole of the third transistor T3 is connected with the reference voltage terminal Ref, and the second pole of the third transistor T3 is connected with the first pole of the driver transistor DTFT. The control pole of the fourth transistor T4 is connected with the scanning signal terminal G(n), the first pole of the fourth transistor T4 is connected with the second pole of the driver transistor DTFT, and the second pole of the fourth transistor T4 is connected with the node P.

Correspondingly, the driving method of the pixel circuit as shown in FIG. 8 is substantially identical with the above mentioned driving method, with the only difference lying in the threshold compensation phase. Thus, the threshold compensation phase of the pixel circuit as shown in FIG. 8 will be described only with reference to FIG. 4, and the other phase will not be reiterated.

Figure 9:
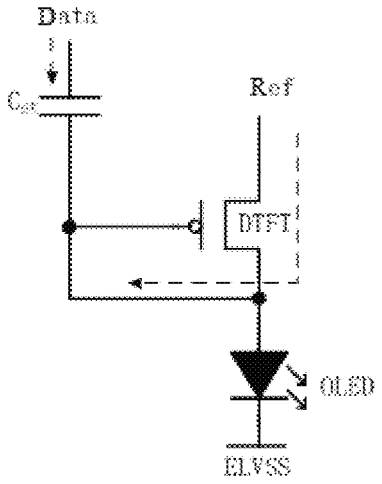
FIG. 9 is an equivalent circuit diagram of the pixel circuit shown in FIG. 8 in a threshold compensation phase.

As shown in FIG. 4, in the threshold compensation phase t2, a high level is inputted from the reset signal terminal Reset and the light-emitting control signal terminal, and a low level is inputted from the scanning signal terminal G(n). At this time, the first transistor T1, the second transistor T2 and the sixth transistor T6 are cut off, and the third transistor T3, the fourth transistor T4 and the fifth transistor T5 are turned on. An equivalent circuit diagram is shown in FIG. 9. In this phase, since the fourth transistor T4 is turned on, the driver transistor DTFT is connected in the form of a diode. Since the third transistor T3 is turned on, the reference voltage inputted from the reference voltage terminal Ref is transmitted to the first pole of the driver transistor DTFT.

In certain exemplary embodiments, the voltage value inputted from the second power supply terminal ELVSS is Vss, the reference voltage value from the reference voltage terminal Ref is Vref, and $0<Vref-Vss\leq 0.3V$.

In such an exemplary embodiment, the reference voltage value Vref is relatively close to the voltage value Vss inputted from the second power supply terminal ELVSS, and the voltage difference between Vref and Vss is mainly used to ensure that no current flows through the light-emitting element OLED in the threshold compensation phase, and meanwhile the reference voltage Vref enters into the first pole of the light-emitting element OLED to reset the light-emitting element OLED, eliminate non-combined charge carriers on the light-emitting interface within the light-emitting element OLED, and alleviate the aging of the light-emitting element OLED. Of course, as realized by those skilled in the art, 0.3V is only an example. Under the teaching of the present disclosure, those skilled in the art can arrange other voltage difference.

In the threshold compensation phase t2, the reference voltage Vref is set to be greater than the initialization signal inputted from the initialization signal terminal Init by the absolute value of the threshold voltage of the driver transistor DTFT. At this time, the control pole of the driver transistor DTFT is still an initialization signal, so the driver transistor DTFT is turned on in the form of a diode due to the fourth transistor T4, so that the reference voltage Vref charges the storage capacitor Cst through the driver transistor DTFT. With the continuous in-flow of charges, the potential of the node P keeps rising. When the potential of the node P rises to be less than the reference voltage Vref by the threshold voltage of the driver transistor DTFT, the driver transistor DTFT is cut off, and charging is finished. Since the fifth transistor T5 is turned on, the data voltage inputted from the data signal terminal Data is transmitted to the first terminal of the storage capacitor Cst. Thus, when the threshold compensation phase ends, the voltage difference between the two terminals of the storage capacitor Cst is: $V(Cst)=Vdata-(Vref-|Vthd|)$, wherein Vthd is the threshold voltage of the driver transistor DTFT.

Similar to the previous depiction, the source-gate voltage Vsg of the driver transistor DTFT is $Vsg=V(C_{st})=Vdata-Vref+|Vthd|$, wherein Vth is the threshold voltage of the driver transistor DTFT.

Since the first power supply voltage VDD inputted from the first power supply terminal ELVDD can ensure that the driver transistor DTFT works in saturation state, the current flowing through the light-emitting element OLED is $I_{oled}-K(Vsg-|Vth|)^2=K(Vdata-Vref+|Vthd|-|Vthd|)^2=K(Vdata-Vref)$, wherein K is a constant related to process and design.

As known from the above equation, the light-emitting current of the light-emitting element OLED is only associated with the data voltage Vdata and the reference voltage Vref, and not associated with the threshold voltage Vthd of the driver transistor DTFT and the first power supply voltage VDD.

Further, the exemplary embodiment of the present disclosure also provides a display device comprising any pixel circuit as stated above.

It can be understood that the above embodiments are only exemplary embodiments of the present disclosure used for explaining the principle of the present disclosure, but the present disclosure is not limited thereto. As far as those ordinarily skilled in the art are concerned, various variations and modifications can be made without departing from the spirit and essence of the present disclosure. These variations and modifications are regarded as falling within the protection scope of the present disclosure.

What is claimed is:

1. A pixel circuit, comprising: an initialization signal terminal, a scanning signal terminal, a data signal terminal, a first power supply terminal, a second power supply terminal, a reference voltage terminal, a light-emitting control signal terminal, a reset signal terminal, a data writing sub-circuit, a threshold compensation sub-circuit, a light-emitting control sub-circuit, a reset sub-circuit, a storage capacitor, a driver transistor and a light-emitting element, wherein the data writing sub-circuit is connected with the scanning signal terminal, the data signal terminal and a first terminal of the storage capacitor, and configured to, under a control of a scanning signal inputted from the scanning signal terminal, transmit a data signal inputted from the data signal terminal to the first terminal of the storage capacitor, wherein the threshold compensation sub-circuit is connected with a first pole and a second pole of the driver transistor, a node, the scanning signal terminal, the reference voltage terminal and a first pole of the light-emitting element, and configured to pre-store a threshold voltage of the driver transistor in the storage capacitor, wherein the light-emitting control sub-circuit is connected with the first power supply terminal, the first terminal of the storage capacitor, the first pole of the driver transistor and the light-emitting control signal terminal, and configured to, under a control of a light-emitting control signal inputted from the light-emitting control signal terminal, control the driver transistor to drive the light-emitting element to emit light, wherein the reset sub-circuit is connected with the node, the reset signal terminal and the initialization signal terminal, and configured to, under a control of a reset signal inputted from the reset signal terminal, transmit an initialization signal inputted from the initialization signal terminal to the node, wherein a second terminal of the storage capacitor and a control pole of the driver transistor are connected with the node, and wherein a second pole of the light-emitting element is connected with the second power supply terminal.

2. The pixel circuit according to claim 1, wherein $0<Vref-Vss\leq 0.3V$, and wherein Vss is a voltage value inputted from the second power supply terminal, and Vref is a reference voltage value inputted from the reference voltage terminal.

3. The pixel circuit according to claim 1, wherein the light-emitting control sub-circuit comprises a first transistor and a second transistor, wherein a first pole of a first transistor is connected with a second pole of the second transistor and the first power supply terminal, a second pole of the first transistor is connected with the threshold compensation sub-circuit and the first pole of the driver transistor, and a control pole of the first transistor is connected with the light-emitting control signal terminal, and wherein a first pole of the second transistor is connected with the first terminal of the storage capacitor and the data writing sub-circuit, the second pole of the second transistor is connected with the light-emitting control sub-circuit, and a control pole of the second transistor is connected with the light-emitting control signal terminal.

4. The pixel circuit according to claim 1, wherein the threshold compensation sub-circuit comprises a third transistor and a fourth transistor, wherein a first pole of the third transistor is connected with the reference voltage terminal, a second pole of the third transistor is connected with the second pole of the driver transistor and the first pole of the light-emitting element, and a control pole of the third transistor is connected with the scanning signal terminal, and wherein a first pole of the fourth transistor is connected with the first pole of the driver transistor, a second pole of the fourth transistor is connected with the node, and a control pole of the fourth transistor is connected with the scanning signal terminal.

5. The pixel circuit according to claim 1, wherein the threshold compensation sub-circuit comprises a third transistor and a fourth transistor, wherein a first pole of the third transistor is connected with the reference voltage terminal, a second pole of the third transistor is connected with the first pole of the driver transistor, and a control pole of the third transistor is connected with the scanning signal terminal, and wherein a first pole of the fourth transistor is connected with the second pole of the driver transistor, a second pole of the fourth transistor is connected with the node, and a control pole of the fourth transistor is connected with the scanning signal terminal.

6. The pixel circuit according to claim 1, wherein the data writing sub-circuit comprises a fifth transistor, and wherein a first pole of the fifth transistor is connected with the data signal terminal, a second pole of the fifth transistor is connected with the first terminal of the storage capacitor and the light-emitting control sub-circuit, and a control pole of the fifth transistor is connected with the scanning signal terminal.

7. The pixel circuit according to claim 1, wherein the reset sub-circuit comprises a sixth transistor, and wherein a first pole of the sixth transistor is connected with the initialization signal terminal, a second pole of the sixth transistor is connected with the node, and a control pole of the sixth transistor is connected with the reset signal terminal.

8. A display device comprising a pixel circuit according to claim 1.

9. The pixel circuit according to claim 1, wherein the light-emitting control sub-circuit comprises a first transistor and a second transistor, the threshold compensation sub-circuit comprises a third transistor and a fourth transistor, the data writing sub-circuit comprises a fifth transistor, and the reset sub-circuit comprises a sixth transistor, wherein a first pole of the first transistor is connected with a second pole of the second transistor and the first power supply terminal, a second pole of the first transistor is connected with a first pole of the fourth transistor and a first pole of the driver transistor, and a control pole of the first transistor is connected with a light-emitting control signal terminal, wherein a first pole of the second transistor is connected with a first terminal of the storage capacitor and a second pole of the fifth transistor, the second pole of the second transistor is connected with the first pole of the first transistor and the first power supply terminal, and a control pole of the second transistor is connected with the light-emitting control signal terminal, wherein a first pole of the third transistor is connected with the reference voltage terminal, a second pole of the third transistor is connected with a second pole of the driver transistor and the first pole of the light-emitting element, and a control pole of the third transistor is connected with the scanning signal terminal, wherein the first pole of the fourth transistor is connected with the first pole of the driver transistor, a second pole of the fourth transistor is connected with a second pole of the sixth transistor and a node, and a control pole of the fourth transistor is connected with the scanning signal terminal, wherein a first pole of the fifth transistor is connected with the data signal terminal, a second pole of the fifth transistor is connected with the first terminal of the storage capacitor and the first pole of the second transistor, and a control pole of the fifth transistor is connected with the scanning signal terminal, wherein a first pole of the sixth transistor is connected with the initialization signal terminal, the second pole of the sixth transistor is connected with the node, and a control pole of the sixth transistor is connected with the reset signal terminal, the first terminal of the storage capacitor is connected with the first pole of the second transistor and the second pole of the fifth transistor, and a second terminal of the storage capacitor is connected with the node, a first pole of the driver transistor is connected with the second pole of the first transistor and the first pole of the fourth transistor, the second pole of the driver transistor is connected with the first pole of the light-emitting element and the second pole of the third transistor, and a control pole of the driver transistor is connected with the node, and the first pole of the light-emitting element is connected with the second pole of the third transistor and the second pole of the driver transistor, and a second pole of the light-emitting element is connected with the second power supply terminal.

10. The pixel circuit according to claim 1, wherein the light-emitting control sub-circuit comprises a first transistor and a second transistor, the threshold compensation sub-circuit comprises a third transistor and a fourth transistor, the data writing sub-circuit comprises a fifth transistor, and the reset sub-circuit comprises a sixth transistor, wherein a first pole of the first transistor is connected with a second pole of the second transistor and the first power supply terminal, a second pole of the first transistor is connected with a first pole of the fourth transistor and a first pole of the driver transistor, and a control pole of the first transistor is connected with a light-emitting control signal terminal, wherein a first pole of the second transistor is connected with a first terminal of the storage capacitor and a second pole of the fifth transistor, the second pole of the second transistor is connected with the first pole of the first transistor and the first power supply terminal, and a control pole of the second transistor is connected with the light-emitting control signal terminal, wherein a first pole of the third transistor is connected with the reference voltage terminal, the second pole of the third transistor is connected with the second pole of the first transistor and the first pole of the driver transistor, and a control pole of the third transistor is connected with the scanning signal terminal, wherein the first pole of the fourth transistor is connected with a second pole of the driver transistor, a second pole of the fourth transistor is connected with a node, and a control pole of the fourth transistor is connected with the scanning signal terminal, wherein a first pole of the fifth transistor is connected with the data signal terminal, a second pole of the fifth transistor is connected with the first terminal of the storage capacitor and the first pole of the second transistor, and a control pole of the fifth transistor is connected with the scanning signal terminal, wherein a first pole of the sixth transistor is connected with the initialization signal terminal, a second pole of the sixth transistor is connected with the node, and a control pole of the sixth transistor is connected with the reset signal terminal, wherein the first terminal of the storage capacitor is connected with the first pole of the second transistor and the second pole of the fifth transistor, and a second terminal of the storage capacitor is connected with the node, wherein the first pole of the driver transistor is connected with the second pole of the first transistor and the second pole of the third transistor, the second pole of the driver transistor is connected with a first pole of the light-emitting element and the first pole of the fourth transistor, and a control pole of the driver transistor is connected with the node, and wherein the first pole of the light-emitting element is connected with the first pole of the fourth transistor and the second pole of the driver transistor, and a second pole of the light-emitting element is connected with the second power supply terminal.

11. A driving method for a pixel circuit, comprising a reset phase, a threshold compensation phase and a light-emitting phase, wherein the pixel circuit comprises: an initialization signal terminal, a scanning signal terminal, a data signal terminal, a first power supply terminal, a second power supply terminal, a reference voltage terminal, a light-emitting control signal terminal, a reset signal terminal, a data writing sub-circuit, a threshold compensation sub-circuit, a light-emitting control sub-circuit, a reset sub-circuit, a storage capacitor, a driver transistor and a light-emitting element, and wherein, the data writing sub-circuit is connected with the scanning signal terminal, the data signal terminal and a first terminal of the storage capacitor, and configured to, under a control of a scanning signal inputted from the scanning signal terminal, transmit a data signal inputted from the data signal terminal to the first terminal of the storage capacitor;

the threshold compensation sub-circuit is connected with a first pole and a second pole of the driver transistor, a node, the scanning signal terminal, the reference voltage terminal and a first pole of the light-emitting element, and configured to pre-store a threshold voltage of the driver transistor in the storage capacitor;

the light-emitting control sub-circuit is connected with the first power supply terminal, the first terminal of the storage capacitor, the first pole of the driver transistor and the light-emitting control signal terminal, and configured to, under a control of a light-emitting control signal inputted from the light-emitting control signal terminal, control the driver transistor to drive the light-emitting element to emit light;

the reset sub-circuit is connected with the node, the reset signal terminal and the initialization signal terminal, and configured to, under a control of a reset signal inputted from the reset signal terminal, transmit an initialization signal inputted from the initialization signal terminal to the node;

a second terminal of the storage capacitor and a control pole of the driver transistor are connected with the node; and a second pole of the light-emitting element is connected with the second power supply terminal, wherein, in the reset phase, under the control of the reset signal inputted from the reset signal terminal, transmitting the initialization signal inputted from the initialization signal terminal to the node, wherein, in the threshold compensation phase, pre-storing the threshold voltage of the driver transistor in the storage capacitor, and wherein, in the light-emitting phase, under the control of the light-emitting control signal inputted from the light-emitting control signal terminal, controlling the driver transistor to drive the light-emitting element to emit light.

12. The driving method according to claim 11, wherein, in the threshold compensation phase, $0<Vref-Vss\leq 0.3V$, and wherein Vss is a voltage value inputted from the second power supply terminal, and Vref is a reference voltage value inputted from the reference voltage terminal.

* * * * *